US005765609A

United States Patent [19]

Dalhart et al.

[11] Patent Number: 5,765,609

[45] Date of Patent: Jun. 16, 1998

[54] SPOUT CONSTRUCTIONS FOR FUEL DISPENSING NOZZLES AND METHODS FOR MAKING SAME

[75] Inventors: Mark D. Dalhart, Indian Springs; Charles A. Sunderhaus, Hamilton, both of Ohio

[73] Assignee: Dover Corporation, New York, N.Y.

[21] Appl. No.: 941,128

[22] Filed: Sep. 30, 1997

Related U.S. Application Data

[63] Continuation of Ser. No. 476,502, Jun. 7, 1995, abandoned, which is a continuation-in-part of Ser. No. 986,521, Dec. 7, 1992.

[51] Int. Cl.[6] ..... B65B 1/04

[52] U.S. Cl. ..... 141/206; 141/59; 141/292; 138/113

[58] Field of Search ..... 141/59, 44–46, 141/206–228, 301, 302, 392, 286, 97, 391; 138/113–115

[56] References Cited

U.S. PATENT DOCUMENTS

| | | | |
|---|---|---|---|
| 4,005,339 | 1/1977 | Plantard | 141/392 |
| 4,351,375 | 9/1982 | Polson | 141/98 |
| 5,004,023 | 4/1991 | Monticup, Jr. et al. | 141/208 |
| 5,213,142 | 5/1993 | Koch et al. | 141/59 |

*Primary Examiner*—J. Casimer Jacyna
*Assistant Examiner*—Steven O. Douglas
*Attorney, Agent, or Firm*—Dinsmore & Shohl LLP

[57] ABSTRACT

A vapor recovery nozzle includes a spout construction comprising an outer aluminum tube and an inner nylon tube. The distal ends of the tubes are joined so that the inner tube defines an central fuel passage and, in combination with the outer tube, defines a generally annular vapor return passage. a distal end portion of the outer tube has a reduced wall thickness and its inner end is expanded to mount a locator ring thereon. The spout assembly is telescoped into an adapter that connects the fuel and vapor passages to corresponding passages in the nozzle body. A spout nut threads into the nozzle body and engages the locating ring to mount the spout on the nozzle. The outer spout tube is formed by lathe operations which include turning a fracture groove adjacent its inner end, and, thereafter bending the tube to angle the distal end portion of the tube downwardly from its inner end. A second embodiment teaches the use of structural, synthetic resins in forming the outer spout tube. In alternate embodiment the outer spout tube is compositely formed an outer end portion that provides increased strength for the that portion, where a thin wall tube is employed.

34 Claims, 9 Drawing Sheets

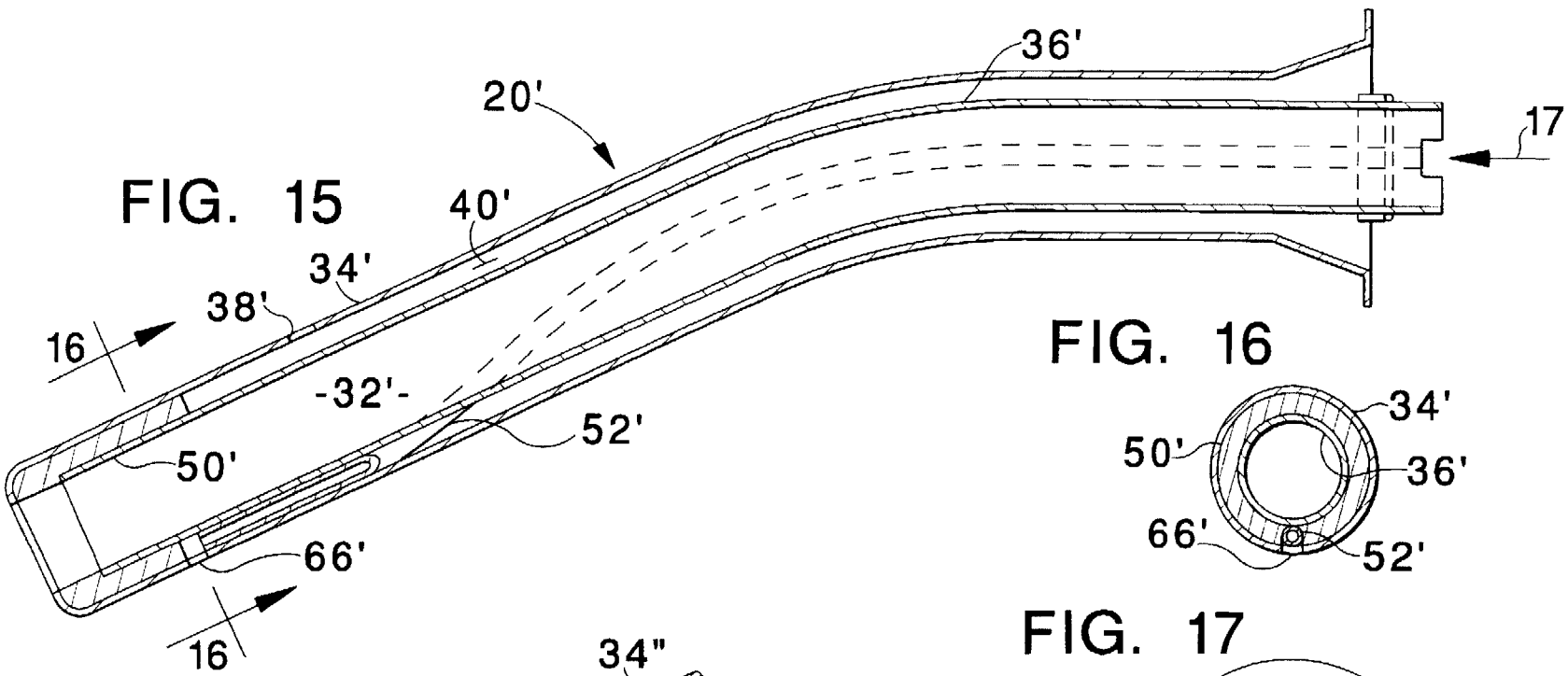
FIG. 15
FIG. 16
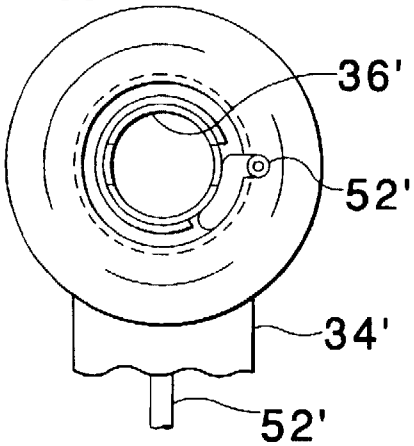
FIG. 17
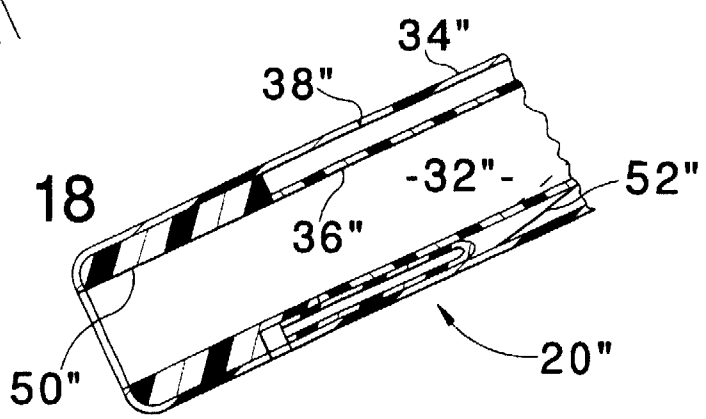
FIG. 18

SPOUT CONSTRUCTIONS FOR FUEL DISPENSING NOZZLES AND METHODS FOR MAKING SAME

This application is a continuation of application Ser. No. 476,502 filed Jun. 7, 1995, now abandoned, which is continuation-in-part of application Ser. No. 986,521, filed Dec. 7, 1992, this letter application being, at times, referenced as the parent application herein.

The present invention relates to improvements in spout constructions employed in fuel dispensing nozzles and methods employed in the maling of same. In a more specific sense the invention relates to improvements in spout constructions that are employed in fuel nozzles having a vapor recovery capability. Other aspects are directed to a nozzle construction that facilitates mounting of the spouts of the present invention.

In recent years there has been an ever increasing pressure, by various governmental entities, to minimize the discharge of pollutants into the atmosphere. Fuel vapors are a particular concern. When a vehicle's fuel tank is filled, hydrocarbon vapors in the tank are displaced as liquid fuel enters the tank. Prior to the concerns over atmospheric contamination, the displaced vapors were simply allowed to escape into the atmosphere. While the amount of contamination from an individual fuel tank is insignificant, when multiplied by literally millions of tankfuls per day, measurable and significant levels of pollution (directly attributable to fuel vapors) can be detected, particularly in areas of high population density.

In order to eliminate this source of pollution, governmental authorities have mandated the use of vapor recovery fuel dispensing systems in an ever increasing percentage of retail filling stations. Basically, a vapor recovery system involves the provision of a vapor return flow path from the nozzle (that is discharging fuel into a vehicle fuel tank) back to the storage tank from which the fuel is being drawn for delivery to the vehicle. Fuel vapors are thus returned to the storage tank (or other area of disposal) rather than being released into the atmosphere.

The initial efforts to comply with vapor recovery regulations were, mostly, based on the use of what is known as a "pressure balance" vapor recovery system. In such system, a vapor return conduit extends from the top of a storage tank to a dispenser pedestal. The usual fuel conduit system also comnects the dispenser with the storage tank. The fuel dispensing nozzle is connected to the pedestal by a hose that includes both fuel and vapor passages. The nozzle also includes passages for both fiuel and vapor. When fuel is being delivered, the nozzle vapor passage is sealed with respect to the inlet pipe for the vehicle fuel tank. Thus, as fuel displaces vapors from the vehicle tank, they are forced into the vapor passageway network that extends through the nozzle body, through the hose and then back to the fuel storage tank. As fuel is drawn from the storage tank and discharged into the vehicle tank, the increase in vapor volume in the storage tank equals (in theory) the decrease in vapor volume in the vehicle tank. There is a concomitant pressure increase in the vehicle tank and decrease in thec storage tank, which causes the return flow of vapor from the vehicle to the storage rank, as a pressure balance in the two tanks is established, hence the name "pressure balance" system.

In a pressure balance system, the sealed connection with the fuel tank inlet pipe is attained by compressing a bellows that surrounds a metal spout tube. The need to compress this bellows made use of a nozzle extremely annoying at best, and impossible for many with only moderate infirmities.

The alternative to the pressure balance vapor recovery system is what is known as a "vacuum assist" vapor recovery system. The vacuum assist vapor recovery system employs the same dual passageway network for fuel and vapors, as in the pressure balance system. The vacuum assist system differs in that it does not require a mechanical seal with the vehicle fuel tank. Instead, a negative pressure is provided at the inlet to the vapor return conduit system, at the nozzle. Displaced vapors are thus drawn into the vapor return system, to prevent their escape into and pollution of the atmosphere.

A nozzle for a vacuum assist vapor recovery system is characterized by an essentially rigid spout tube and is capable of use in essentially the same fashion and with the same facility as nozzles employed in fuel dispensing systems that do not have a vapor recovery capability.

While the basic principles of the vacuum assist system have been known for many years, early attempts at commercialization were limited by several factors. These limiting factors included difficulties in obtaining a vacuum that reliably prevent escape of vapors into the atmosphere, as well as providing nozzles that were effective in providing both a vapor passage and fuel passage in the spout, in addition to the venting passage required for automatic shut-off to prevent overfilling of a fuel tank.

The referenced, parent application is directed to providing fuel nozzles that facilitate the use of vacuum assisted fuel nozzles. The present application has the same object and is more specifically directed to the spout construction of such nozzles and to reducing the costs involved in spout constructions that provide both a fuel passage and a vapor return passage.

Other and more general objects of the invention are directed to reducing the costs associated with the manufacture of rigid spout tubes.

These ends may be attained, in accordance with certain aspects of the invention, by a spout comprised of an outer tube and an inner tube. The inner tube defines a central fuel passage for the spout and, in combination with the outer tube, defines a generally annular vapor passage for the spout. The inner tube is formed from a synthetic resin. Preferably the inner tube is formed of a laterally flexible synthetic resin to enable the use of straight, extruded resin tubing. The latter feature is advantageous in permitting the use of straight, extruding tubing where the distal end portion of the compositely formed spout is angled downwardly from the inner end portion that is attached to the nozzle body. It has been found that extruded, nylon 66 tubing, having a wall thickness of 0.020 inch is preferred as a base material for the inner tube.

The outer tube may be advantageously formed from a synthetic resin, referenced as a "structural plastic". This feature is of particular advantage in forming a spout in which the distal end portion is angled downwardly from the inner end portion.

Other advantages are found in the use of aluminum as the material for the outer spout tube. Aluminum tubing, in accordance with method aspects of the invention, may be first set up in a lathe, a counterbore can then be formed in its end and a circumferential fracture groove formed in what will become the inner end portion of the spout tube. The spout tube may then be severed from the aluminum tubing. Where the spout is to be used for the delivery of unleaded fuel, the distal end portion is turned to a reduced diameter that will freely pass through a restricter plate. (Such plates are mounted in the inlet pipes of fuel tanks in vehicles that are required to use unleaded fuel.)

Continuing with the method aspects of the invention, after the lathe operations, the spout tube may be bent to angle the distal end portion downwardly from the inner end portion. The inner end of the spout tube is then expanded to an enlarged diameter, while maintaining a substantially constant wall thickness ⅛ inch being advantageous.

It is further desirable to position a locator ring in telescoped relation to the inner end portion of the tube, prior to and while it is being expanded. The tube is then expanded to an extent sufficient to swage the tubing material into engagement with the locator ring and mount the locator ring on the tube. The locator ring functions as flange means and is a component of the mechanism for mounting the spout.

It has been found that extruded 6005-T5 aluminum is advantageous, if not necessary, in forming a reliable tracture groove (the function of which is later discussed) in the spout, as well as in mounting the locator ring on the spout by a swaging action.

Other constructional features of the invention are evident in the further method steps of mounting an outer ferrule in the counterbore in the outer spout to form an outer tube subassembly. The outer tube subassembly may further comprise a vent tube that is inserted in a longitudinal slot in the outer ferrule and extends beyond the inner end of the outer tube.

An inner ferrule is then mounted on the inner end of the inner tube. The inner ferrule may comprise a central hub which is telescoped over the inner end of the inner tube and preferably bonded thereto in forming an inner tube subassembly. The distal end of the inner end of the inner tube is then inserted from the inner end of the outer tube, into the outer ferrule. Radial vanes, projecting from the inner ferrule hub, engage the inner surface of the enlarged portion of the outer tube and position the inner end of the inner tube relative thereto.

The described spout assembly is adapted to be mounted on a nozzle body that has an adapter positioned in a bore that extends into an end of the nozzle body opposite the butt end to which a coaxial hose may be mounted. The adapter comprises an inner tubular portion which defines a central fuel passage and an outer tubular portion. The inner and outer tubular portions combine to define an annular vapor passage.

The outer spout tube is telescoped into sealing engagement with the inner surface of the outer tubular portion of the adapter and the inner ferrule of the spout is telescoped into sealing engagement with the inner tubular portion of the adapter, as the spout is mounted on the nozzle. The vapor and fuel passages of the spout are thus placed, respectively, in communication with the corresponding passages in the adapter. Also, as the spout is mounted on the nozzle body, the vent tube is inserted into a venturi venting passage of the adapter to provide an automatic shut-off function.

A spout nut, telescoped over the inner end portion of the outer spout tube, is then threaded into the nozzle body. The spout nut has a counterbore shoulder that engages the locator ring and clamps it against the adapter to lock the spout in mounted relationship on the nozzle.

As is discussed in greater detail below, a major thrust of the constructional features of the invention is to provide maximized flow areas for both the fuel and vapor passages of the spout. In the same vein, it is also an objective to minimize flow obstructions at the juncture with the adapter to which the spout is connected in being mounted on the nozzle body.

The above and other related objects and features of the invention will be apparent from a reading of the following description of a preferred embodiment, with reference to the accompanying drawings, and the novelty thereof pointed out in the appended claims.

In the drawings:

FIG. 15 is a longitudinal section of a spout construction disclosed in said parent application Ser. No. 986,521;

FIG. 16 is a section taken on line 16—16 in FIG. 15;

FIG. 17 is a view taken in the direction of arrow 17 in FIG. 15;

FIG. 18 is longitudinal section of the distal end portion of the spout construction of FIG. 15, modified to comprise synthetic resin components;

Figure 1:
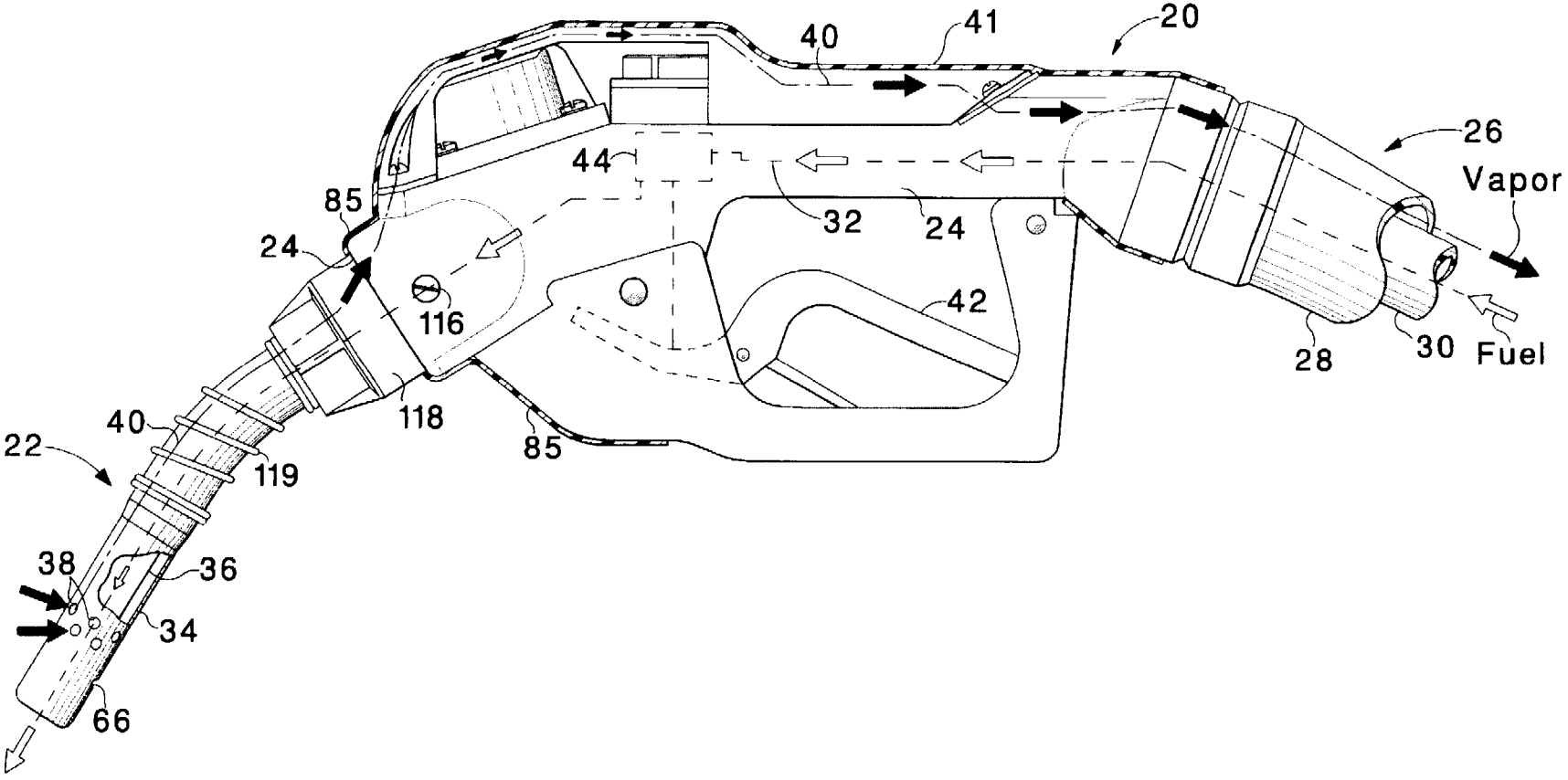
FIG. 1 is an elevation of a vapor recovery nozzle having a spout construction embodying the present invention.

FIG. 1 illustrates a vapor recovery nozzle, indicated generally by reference character 20, the distal end portion of which comprises a spout assembly constructed in accordance with the present invention and indicated generally by reference character 22. The nozzle 20 comprises a body 24 on which the spout assembly 22 is mounted. A coaxial hose 26 is secured to the opposite, or butt end, of the body 24. The coaxial hose comprises two flexible tubes 28, 30, which define a central passage and a concentric annular passage. The coaxial hose extends to a dispenser pedestal where one of the passages is connected with a source of pressurized fuel and the other passage is connected to conduit means that extend to a container that receives the vapor displaced from a vehicle fuel tank, as the tank is filled with fuel discharged from the nozzle. In the usual case, the vapors are returned to the storage tank from which fuel is drawn to be discharged from the nozzle.

It will be noted that where fuel flow is through the central passage and vapor flow is through the annular passage of a coaxial hose, it is referenced as a "standard" coaxial hose. Where fuel flow is through the annular passage and vapor flow is through the central passage, it is referenced as an "inverted" coaxial hose. For sake of illustration, the hose 26 is shown as a standard coaxial hose. However, an inverted coaxial hose could be employed, by making appropriate connections with vapor and fuel passages at the butt end of the nozzle body.

The fuel flow path in FIG. 1 is indicated by outline arrows and dashed line 32. It will be seen that fuel flows from the central hose passage, defined by tube 30, though the nozzle body 24 and then though the spout assembly 22 for discharge from the distal end of the spout 22. At this point it will be noted that the spout 22 is compositely formed and comprises a spout assembly that includes an outer tube 34 and an inner tube 36. The inner tube 36 defines the fuel flow path through the spout assembly. The inner and outer tubes combine to define a flow path longitudinally through the spout assembly. This flow path is generally annular, although the inner tube 36 is not necessarily concentric of the outer tube 34 at all points along its length.

This generally annular passage provides a vapor return flow path through the spout. It extends from inlet openings 38 (spaced inwardly from the distal end of the spout) along the length of the spout, to nozzle body 24. The vapor return flow path is indicated by broken line 40 and solid arrows. It extends from the spout assembly, through the nozzle body 24, though a vapor passage cap 41, and then back through the nozzle body 24, where connection is made with the annular passage of the coaxial hose 26.

The nozzle of the present invention is primarily intended for use in a vacuum assisted vapor recovery system. In such vapor recovery svstem, the vapor return passage is connected to a vacuum pump, usually located at the dispenser pedestal. In conventional use of a fuel dispensing nozzle, the distal end portion of the spout is inserted into the upper end portion of the inlet pipe to a vehicle fuel tank. By providing a negative pressure in the vapor return passage, vapors are drawn into the inlet openings 38, without the need of a seal between the spout and inlet tube.

This vacuum assist system is a preferred alternative to so called pressure balance vapor recovery systems, which also include a vapor return passage system that extends from the vehicle fuel tank to the storage tank from which fuel is drawn. In pressure balance systems, a mechanical seal (usually provided by compressing a bellows) is required between the spout and the tank inlet pipe. When this seal is in effect, there is an increase in vapor pressure as fuel is introduced into the vehicle's tank. The vapor is thus forced into the vapor return flow path and return flow (from vehicle tank to storage tank) is induced as the vapor system tends to stabilize at a pressure balanced condition. It will become apparent that the present invention, or at least significant aspects thereof, is applicable to fuel dispensing nozzles employed in pressure balance, vapor recovery systems.

Operation of the present nozzle is conventional in the provision of an operating lever 42 that can be raised to open a valve 44 that controls flow of fuel through the fuel passage 32. The details of the spout assembly 22 will now be described in detail, with reference first to FIGS. 2–4, 7 and 8.

The spout assembly comprises an outer tube subassembly 46 and an inner tube subassembly 48. The outer tube subassembly 46 comprises the outer spout tube 34, a ferrule 50, a vent tube 52 and a locator ring 54. Forming of the outer tube 34 and mounting of the locator ring 54 thereon is accomplished through novel method aspects of the invention, which will now be described.

Figure 19:
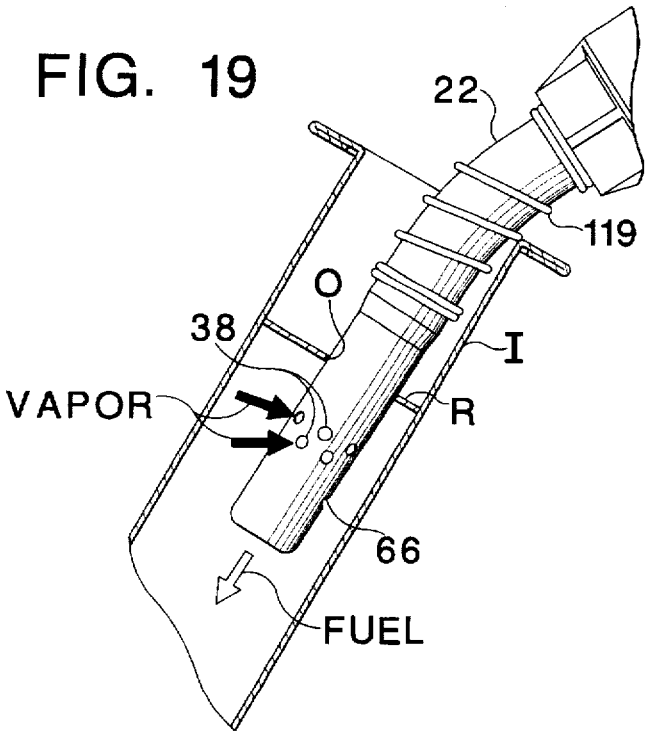
FIG. 19 is a fragmentary view, partially in longitudinal section, illustrating the distal end portion of the nozzle spout positioned in an inlet pipe to a vehicle fuel tank.
Figure 7:
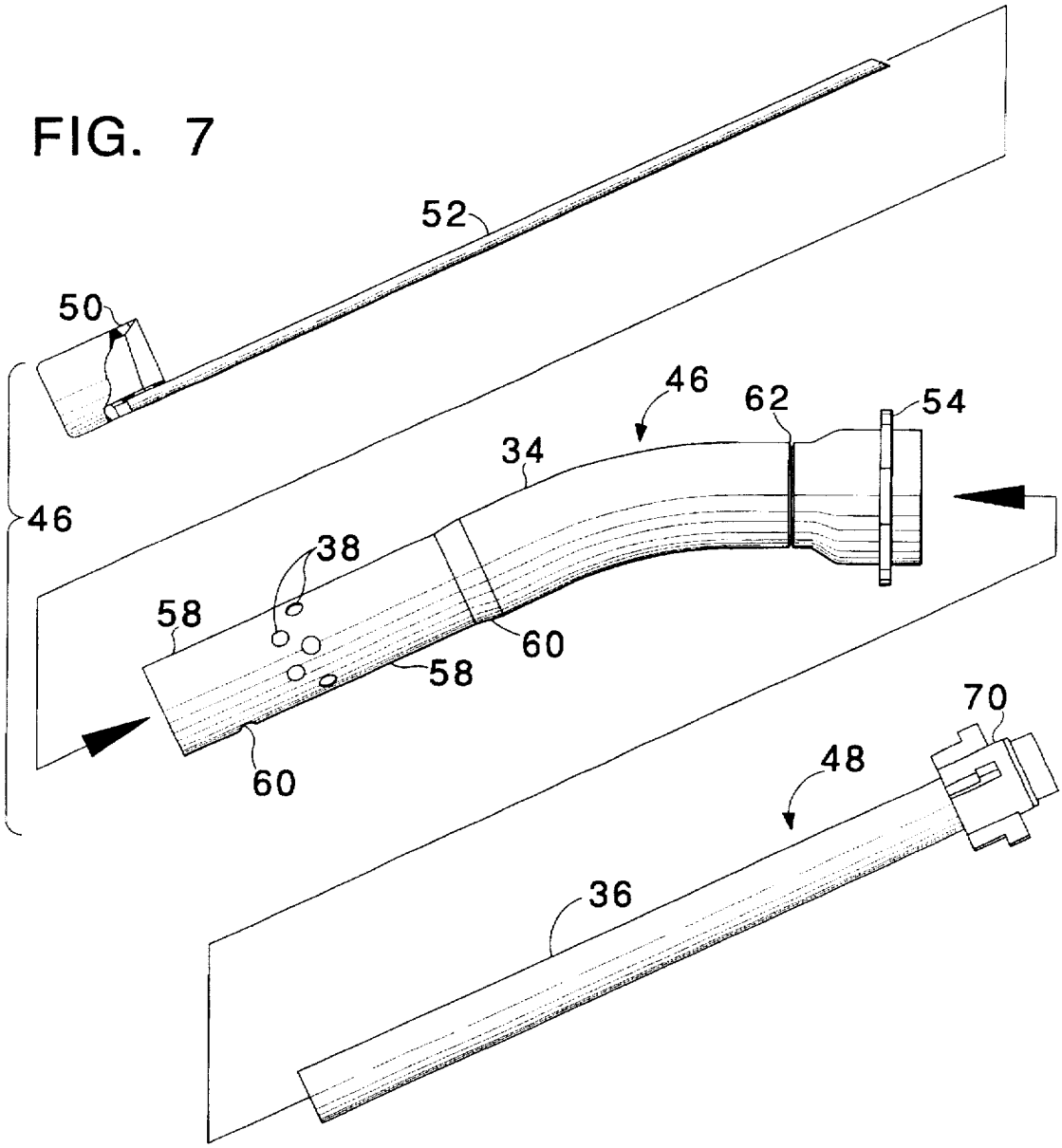
FIG. 7 is an exploded view of the spout assembly.
Figure 8:
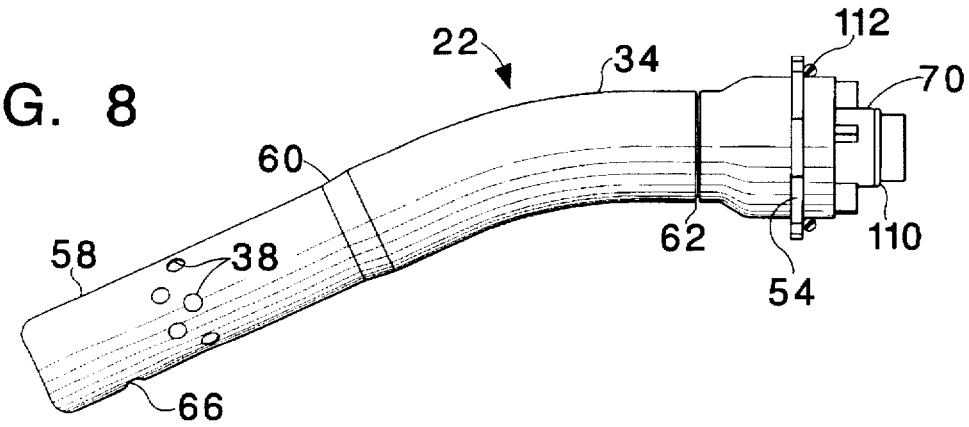
FIG. 8 is an elevation illustrating the spout assembly.

As indicated earlier, there as several ends sought to be met by the present invention. These ends include light weight and resistance to abuse, along with an economical construction. Such ends are attained by the use of aluminum as the material for the outer spout tube 34. The specific end of resistance to abuse, while providing a minimum weight, is met by the use of aluminum tubing having a substantial wall thickness at its inner end portion and a reduced wall thickness at its distal end portion. By governmental regulation, vehicles powered by engines, that operate on unleaded gasoline, are provided with a restricter plate in the upper end of the inlet pipe to the vehicle's fuel tank. This is illustrated in FIG. 19, where the distal end portion of the spout 22 is positioned in an inlet pipe I and inserted through an opening O formed in the restricter plate, which is identified by reference character R.

The diameter of the restricter plate opening thus establishes the maximum diameter for the distal end portion of a spout for a nozzle intended for delivery of unleaded fuel. The diameter of the restricter plate opening, with appropriate allowance for clearance and manufacturing tolerances dictates a diameter for the distal end portion of the outer spout tube 34 of approximately 0.810 inch. From this base point, it has been determined that a wall thickness of approximately 0.050 inch, at the distal end portion of the tube, provides sufficient strength to avoid damage due to abuse that is inherent in normal usage of the nozzle. It is also to be noted that the wall thickness of the distal end portion of the tube 34 is a function of the length of the reduced diameter. Thus, in order to obtain a minimum wall thickness, the length of the reduced diameter section is preferably limited to that necessary to position the vapor inlet openings 38 on the fuel tank side of the restricter plate—this relationship being necessary to minimize, if not entirely prevent, escape of vapors into the atmosphere.

In order to obtain this relationship relative to the restricter plate, and to accommodate other constructional features, it has been found that a reduced diameter length of approximately 2¾ inches is appropriate for the wide range of inlet pipe/restricter plate configurations on different makes and models of vehicles.

It is to be further appreciated that this extended discussion of dimensional relationships has for its further and ultimate end the maximization of flow areas for the fuel and vapor passages, as is further dealt with below.

The required strength characteristics for the outer spout 34 are achieved by providing the inner end portion of spout tube 34 with a wall thickness of approximately ⅛ inch and an outer diameter of approximately 0.960 inch. Sizing of the spout tube 34 can also be affected by the sizes of commercially available extruded aluminum. Aluminum tubing having an outer diameter of approximately 0.960 inch and an inner diameter of approximately 0.710 inch, which tubing is the starting point for forming the spout tube 34.

Figure 9:
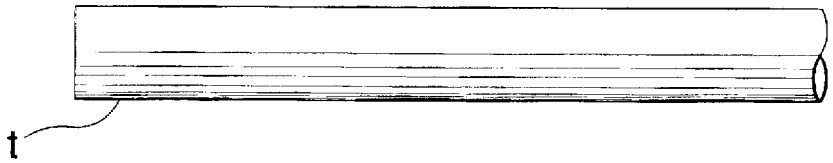
FIGS. 9, 10, 11, 12, 13 and 14 illustrate the successive steps in forming a component of the spout assembly.
Figure 10:
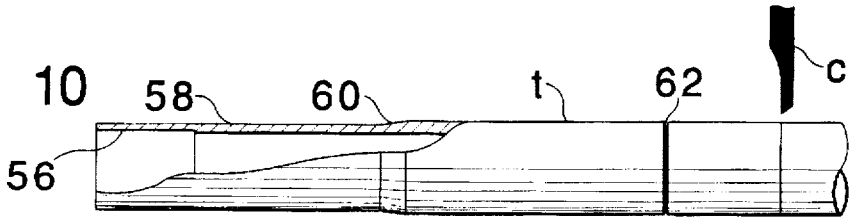

FIG. 9 illustrates a length of tubing t, mounted for lathe operations. The lathe operations are indicated in FIG. 10 and include forming a counterbore 56 in the distal end of the tube, to a depth approximating, or somewhat greater than, the length of the ferrule 50. The distal end portion 58 of the nozzle is then turned down to the maximum diameter deemed suitable for insertion through the opening in a restricter plate, or to a lesser diameter that still provides sufficient strength for the distal end portion of the nozzle to withstand normal physical abuse. The length if the reduced diameter, distal portion 58 of the spout is the minimum necessary to permit the vapor return entrance holes 38 to be positioned inside the fuel pipe restricter plate (R), when the spout is inserted therethrough (see above discussion of FIG. 19). A reduced diameter length of approximately 2¾ inches is typical. It is also noted that, preferably, there is a conical ramp 60 that leads from the reduced diameter portion to the inner portion of the spout, which is in its "as extruded" condition. The ramp 60 eliminates any a sharp edge at the change in diameters and thus minimizes the possibility of its being a hazard, or subjected to abuse in use.

The next operation in the lathe procedures is turning a groove 62 in its inner end portion. The groove 62, referenced as a breakaway fracture groove, provides a predetermined failure mode in the event a vehicle is driven away from a fuel dispenser with the spout still inserted in the fill pipe of its fuel tank. The provision of a breakaway groove is a well known expedient. However, the present invention departs from prior teachings in that the groove is formed during the setup for lathe procedures and prior to bending the spout to angle the distal end portion relative to the inner portion thereof, as will next be described in connection with the present spout tube 34. Prior attempts to form a fracture groove prior to bending have not been successful because of an inability to obtain a spout that will reliably fail when subject to a desired predetermined force. Obtaining an accurate failure force is necessary to prevent more serious damage than the simple loss of a nozzle spout in the event of driveaway. If the spout fails to fracture at this predetermined force, more serious damage can result, such as toppling the dispenser pedestal.

It has been determined that the ability to form the fracture groove (62) during the lathe set up and before bending is due to the preferred use of 6005-T5 aluminum (American Alloy Association alloy number and temper number) the described lathe operations have been completed, a cut off tool c can be employed to sever the length of tubing t, that will comprise a spout tube 34, from the extruded length of tubing stock. It is to be appreciated that the counterboring, turning and groove forming steps do not necessarily have to be performed in the order described. However, this order does provide greater stability to the tubing as it is being formed and thus provides a greater accuracy in the finished spout tube.

Those skilled in the art will appreciate that the described sizing of the distal end portion of the tube 34 is to meet the requirements for unleaded fuel. Where the spout tube is to be employed for nozzles employed in dispensing leaded fuel, the step of turning the distal end portion of the nozzle is simply omitted. The remaining features of the invention are, however, suitable for spouts used in nozzles that are employed in the delivery of leaded fuel.

Figure 11:
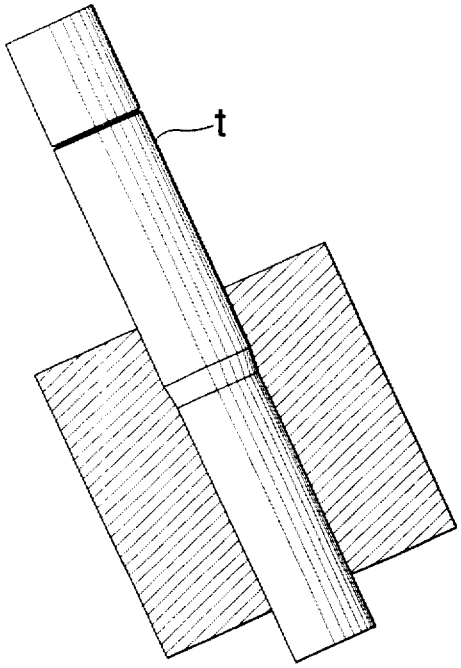
Figure 12:
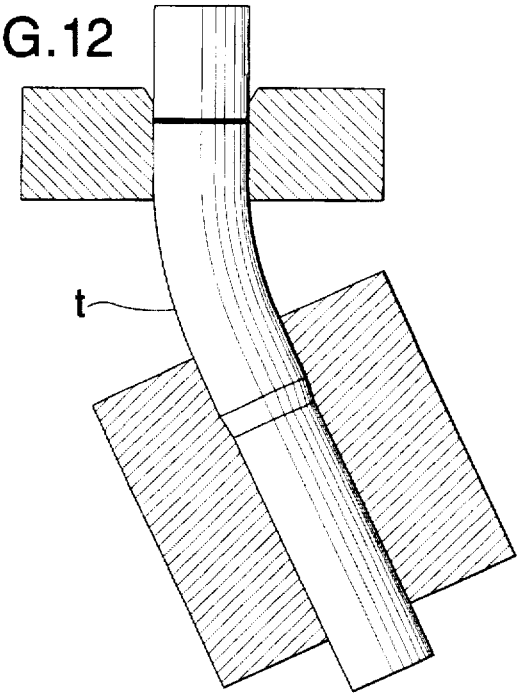
Figure 13:
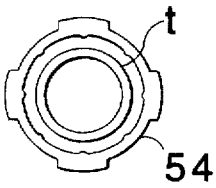
Figure 14:
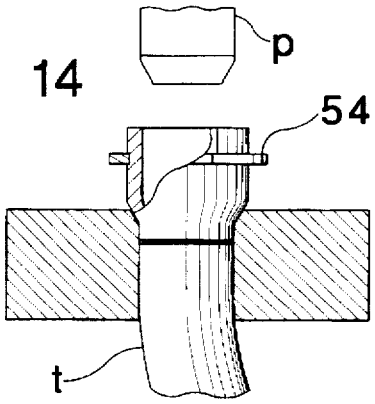

Following the lathe operations, the severed length of tubing t is then bent to angle the inner end portion of the length of tubing relative to what will become the distal end portion of the spout. The bending procedure is illustrated in FIGS. 11 and 12, showing the length of tube being appropriately restrained by dies that are displaced to provide the bending function.

The final step of making the spout tube 34 is to enlarge a short portion of what will become the inner end portion of the tube and to simultaneously mount the locator ring 54 thereon. This step can be performed with the inner and distal end portions of the tubing length maintained clamped in the same dies that were employed in the bending step. The end of expanding the upper end portion of the tubing can be obtained by a straightforward swaging (cold forming) operation wherein a tapered plunger p is telescoped downwardly into the end of the tube t, to the depth desired for the diameter of the inner end portion to be enlarged. After this depth is reached, the forming plunger is raised, permitting the formed tube to be removed.

Prior to the upper end portion of the tube being enlarged in this fashion, a locator ring 54 is positioned at a desired location spaced downwardly from the upper end of the tube and in a horizontal plane, relative to the vertical axis of the tube. It is to be appreciated that the locator ring 54 has a plurality of angularly spaced lugs 64 projecting inwardly from its inner diameter, which ring diameter approximates the outer diameter to which the tube is to be expanded by the plunger p. Thus, as the tube t is expanded, the lugs 64 become embedded in the tube wall to lock the locator ring 54 rigidly and securely thereon. It is to be further appreciated that this attachment is achieved without unduly weakening either the tube wall or the locator ring itself.

The inner diameter of the tube is increased approximately 25% in the enlarging/swaging process. This substantial increase in diameter contributes to the economies achieved in manufacturing the present spout assembly, in that it facilitates maintaining a required minimum flow area for the vapor flow path at its juncture with the nozzle body, all as will be fully discussed in subsequent description. In any event, the enlarging/swaging process is facilitated by the referenced use of 6005-T5 aluminum tubing as the spout tube material. It is to be understood that the bending operation could be performed subsequent to the step of enlarging the inner end portion of the tube and mounting of the locator ring thereon. However, the described order of steps is preferred. After attachment of the locking ring 54, the vapor inlet holes may be formed in the tube 34 along with a vent opening 66 that is employed in providing an automatic shut-off function for the nozzle.

The vent tube 52 may be positioned in a longitudinal slot 68, formed in the ferrule 50, which slot terminates short of the distal end of the ferrule 50. The distal end of the tube 52 is spaced from the distal end of the slot 68. The tube 52 is formed of a standard nylon material, nylon 66 being suitable. The ferrule 50 may be injection molded, with nylon 66 also being a suitable material.

The ferrule 50 and tube 52 may then be inserted through the distal end of the spout tube to bottom the ferrule 50 against the inner end of the counterbore 56. The distal end of the tube is then swaged inwardly to secure the block in place. It is also to be appreciated that there is a close fit between the ferrule 50 and the outer tube so that, preferably, the holes 38 provide the sole entrance means to the annular, vapor return passage 40. The objective is to minimize the entrainment of liquid fuel in the vapor return passage. It is also to be appreciated that the distal end of the slot 68 is registered with the tube opening 66, thereby providing an outlet for the vent tube 52, at the bottom of the spout tube and immediately above its distal end.

The inner tube subassembly 48 comprises the inner tube 36 and an inner ferrule 70. The inner ferrule 70 may be an injection molded, acetal or nylon resin, and comprises a central hub 72, which is telescoped over the inner end of inner tube 36. The tube 36 is bottomed against the end of a counterbore in the hub 72. The tube 36 is formed as a resin extrusion, nylon 66 again being a suitable material. A suitable adhesive or solvent may be employed to bond the inner ferrule 70 to the inner tube 36.

The inner tube assembly 48 is then joined to the outer tube assembly 46 by inserting the distal end of the inner tube 36 though the inner end of the outer spout tube 34. The significance of the inner tube being formed of a relatively flexible resinous material becomes apparent at this point, in that the inner tube, flexes and follows the curvature of the relatively rigid outer tube, as it is telescoped into the outer tube. Nylon 66 is a thermoplastic material. Thus, the inner tube can be heated to facilitate its taking a curvature without collapsing the wall.

This is to point out that there is some criticality in configuring the inner tube and in the selection of its material. As indicated, it is highly desirable that the tube essentially maintain its circular cross section, as it is bent to a longitudinal curvature, otherwise, the cross sectional area of the fuel flow passage will be unduly reduced and the rate at which fuel can be delivered will be reduced to an unacceptable level. It is again noted that the orifice of the restricter plate is the primary limiting factor on flow rates. That is, the cross sectional areas for both fuel flow and vapor return flow must be sized within the constraint of the restricter orifice and still provide for a tube wall thicknesses that will provide sufficient strength to withstand normal abuse in use, and more particularly a strength such that the tube wall will not collapse when bent. It has been found that nylon 66 tubing, having a half inch outer diameter and a wall thickness of 0.020 inches allows for longitudinal bending of the tube with a minimal decrease in fuel flow area, while at the same time meeting the other desired and necessary characteristics, such as having sufficient strength to withstand the internal pressure generated by the fuel being delivered.

It will be further noted that the outer ferrule 50 has a bore 74 which is vertically offset from the central axis of the ferrule. This offset has two purposes. First, it facilitates connection of the vent tube 52, as previously described. Second, the offset facilitates connection of the inner tube thereto, in that the degree to which the inner tube must be flexed is minimized. Connection of the inner tube 36 to the outer ferrule 50 is further facilitated by a beveled, or conical inner, entrance end, indicated at 76.

The inner end of the inner tube subassembly 48 is positioned relative to the inner end of the outer tube assembly 46, by vanes 78, projecting radially from the inner ferrule hub 72. The inner ends of the vanes 78 slidingly engage the inner diameter of the enlarged, inner end portion of the outer spout tube 34 to position the inner tube 36 centrally thereof. The vanes 78 have shoulders 80, which are engaged with the inner end of the spout tube 34 to longitudinally position the inner tube assembly 48 relative to the outer tube assembly 46.

In telescoping the inner tube assembly into the outer spout rube 34, the vent tube 52 is positioned, in a relative sense, with respect to the spout tube 34. That is, the inner tube assembly is positioned in an angular sense about the axis of the spout tube 34. The spout tube 34 has an angled indentation 82, at a three o'clock position, as viewed in FIG. 5A, reference also FIG. 5B. It will next be noted that the inner ferrule has a fifth radial vane 84 that defines a recess for receiving the inner end of the vent tube 52. As the inner tube 36 is inserted into the outer spout tube 34, the vent tube, positioned in the recess defined by the fifth vane 84, is aligned with the recess 82, in the outer spout tube. The vent tube 52 is thus spiraled from a lower, six o'clock position at the distal end of the spout to a three o'clock position at its inner end.

It has been found that the friction forces effective between the inner subassembly 48 and outer subassembly 46 are sufficient to maintain their assembled positions, without the need for a locking means in either a longitudinal or angular sense. It is to be further noted that, when mounted on a nozzle body there are no forces on the spout assembly that would tend to cause relative movement between the subassemblies in either a longitudinal or angular direction. The absence of a locking means facilitates disassembly of the subassemblies for replacement of one or the other that might become damaged.

Figure 5:
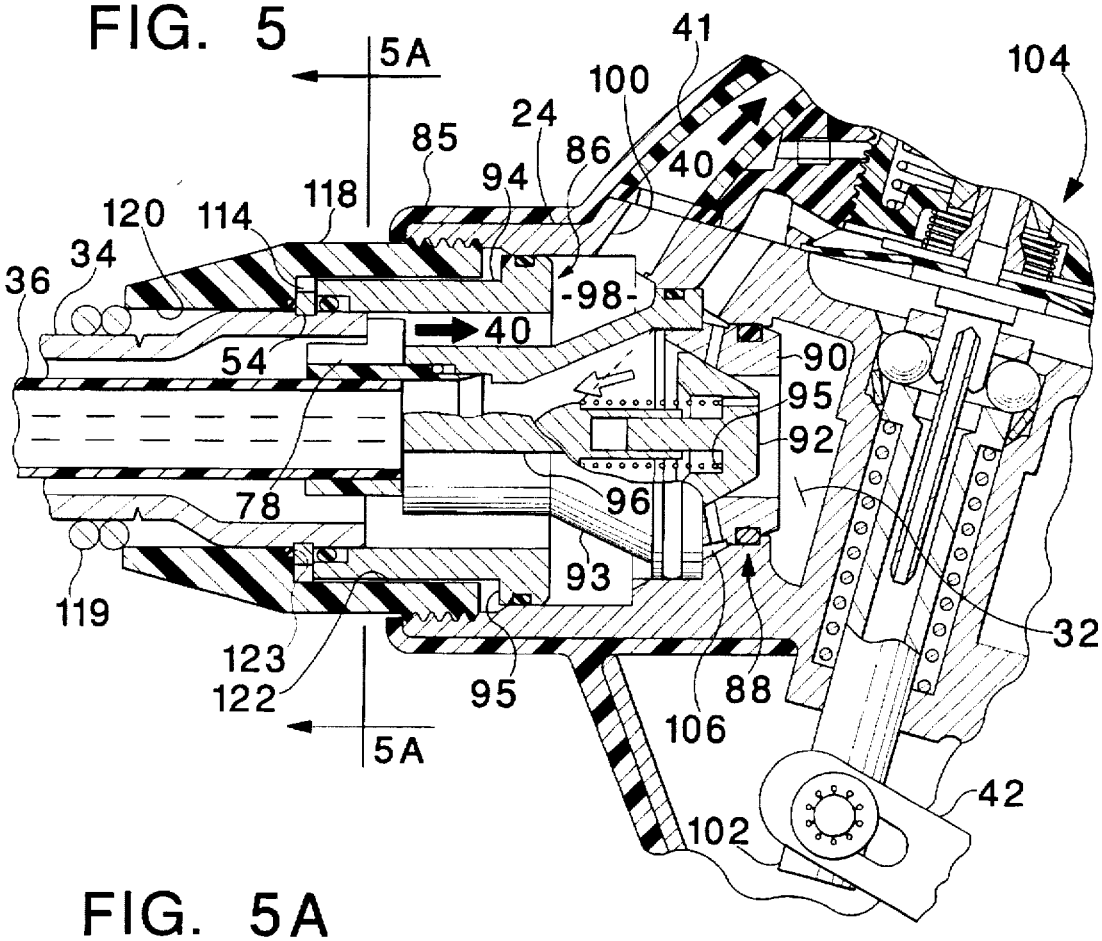
FIG. 5 is a view, in longitudinal section and on a further enlarged scale, illustrating the juncture between the nozzle subassembly and the body portion of the nozzle.
Figure 5A:
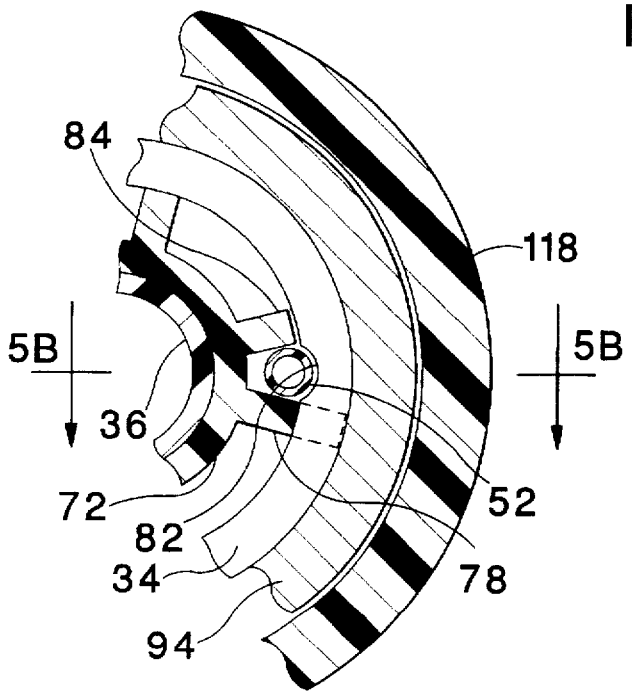
FIG. 5A is a section taken on line 5A—5A in FIG. 5.
Figure 5B:
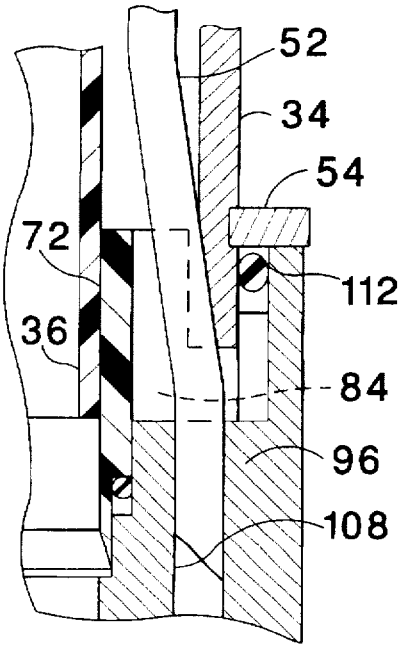
FIG. 5B is a section taken on line 5B—5B in FIG. 5A.
Figure 6:
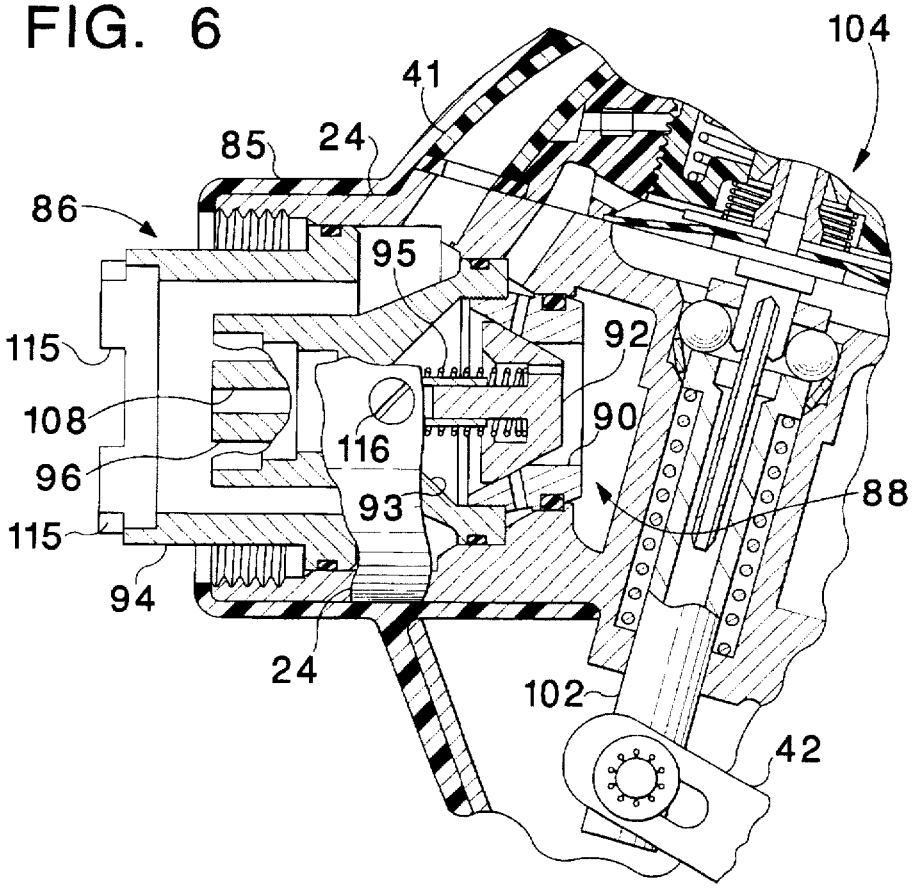
FIG. 6 is a view, similar to FIG. 5, of the body portion of the nozzle, with the spout subassembly removed.

The nozzle components with which the spout assembly cooperate will next be described, with reference to FIGS. 5 and 6. Prior to such description it will be pointed out that the major portions of the nozzle body 24 and vapor cap 41 are enclosed within a scuff guard 85 of relatively soft, vinyl plastic. The scuff guard embodies known teachings.

The distal end portion of the nozzle body 24 defines a portion of the fuel flow passage 32, downstream of the main valve 44. A multi-diameter adapter 86 extends inwardly from the distal end of the nozzle body 24 into an appropriately stepped bore, which diameters are, respectively, sealed with the bore. A venturi check valve 88 is disposed at the upstream end of the adapter 86 and comprises a valve seat 90, threaded into the upstream end of the adapter 86, a poppet 92 that is slidable in a central hub of the adapter 86 and a spring 95, that urges the valve poppet to a closed position.

The adapter 86 has a central tubular portion 93 that defines the portion of the inner, fuel passage 32, downstream of the venturi valve 88. The hub for the venturi poppet is supported by vanes that span the fuel passage. The adapter further comprises an outer tubular portion 94, that is spaced from the inner tubular portion and defines, in combination therewith, a portion of the vapor return passage 40. Vanes 96 span the vapor return passage 40 to support the inner tubular portion 93 of the adapter. One of the diameters of the adapter 86, that is sealed with respect to the nozzle body 24, is in the form of a flange 95 that projects outwardly from the tubular portion 94. The second sealed diameter is provided by a flange that projects outwardly from the inner tubular portion 93, which inner tubular portion extends inwardly beyond the outer tubular portion 94. An annular chamber 98 is thus defined in the vapor return passage 40. A passage 100, in the nozzle body 24, connects the chamber 98 with the vapor return passage in the vapor cap 41.

There is a third passage through the adapter 86 for venting the suction generated by the venturi valve 88, in providing an automatic shut-off function. In operating principle, the automatic shut-off function is well known. Briefly, it will be noted that the main valve, operating lever 42 is pivoted on a trip stem 102. The stem 102 extends through a housing to a trip mechanism 104 having a chamber 106. (The fuel passage 32 splits and goes around the housing for the trip stem 102.) When there is fuel flow through the venturi valve 88, a reduced pressure is formed at the throat of the venturi passage defined by the poppet 92. This reduced pressure draws air from an annular chamber 106, surrounding the valve seat 90. The annular chamber 106 is connected to a passage 108 formed in the vane 96, that connects the inner and outer tubular portions of the adapter 86. The trip mechanism chamber 106 is also connected to the annular, venturi chamber 106, by appropriate passages (not shown) through the inner tubular member 93.

To complete the description of the automatic shut-off feature, when the spout assembly is mounted on the nozzle, as will soon be described, the vent tube 52 is connected to the passage 108 and thus to annular chamber 106. While the spout inlet 66, to the vent tube 52 is not blocked, there is a flow of air therethrough to the annular chamber 106, so that air is drawn into the fuel flowing through the venturi passage. The trip mechanism chamber 104, is thus maintained at a pressure that is at, or minimally below atmospheric pressure. When the spout is inserted into the fill pipe of a vehicle fuel tank, and when the fuel reaches a height sufficient to block the vent inlet 66, the system being otherwise sealed from atmosphere, a vacuum (negative pressure) is generated in the annular chamber 106 and in the trip mechanism chamber 104. The trip mechanism is responsive to this negative pressure, to release the trip stem 102, resulting in valve 44 closing to shut off fuel flow and prevent fuel from overflowing the fill pipe. For a more detailed description of this type of automatic shut-off device, reference is made to the previously identified parent application.

Figure 2:
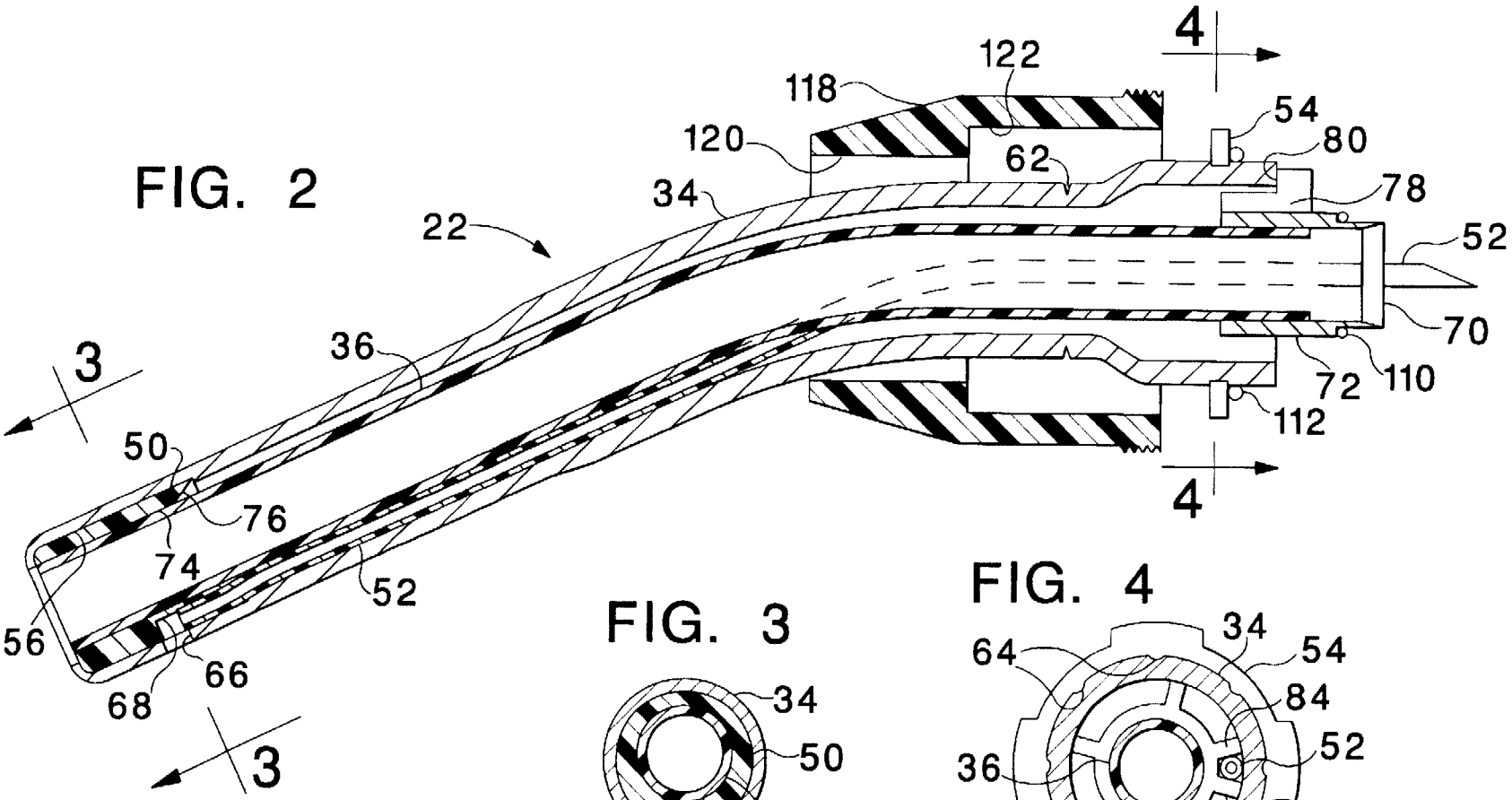
FIG. 2 is an elevation, in longitudinal section and on an enlarged scale, of the spout construction subassembly and mounting nut indicated in FIG. 1.
Figure 4:
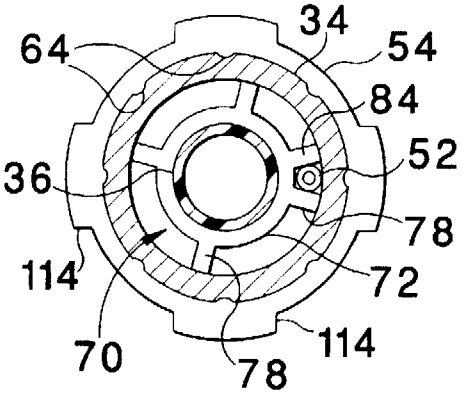
FIG. 4 is a section taken on line 4—4 in FIG. 2.
Figure 3:
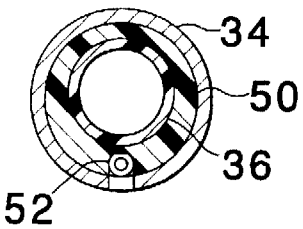
FIG. 3 is a section taken on line 3—3 in FIG. 2.

Reverting to a description of the spout assembly and with particular reference to FIGS. 2 and 4, an O-ring 110 is telescoped over a reduced diameter at the inner end of the inner ferrule hub 72, a second O-ring 112 is telescoped over the inner, expanded end portion of the outer spout tube 34. The vent tube 52 is extended beyond the inner end of the spout assembly so that it can be readily inserted into the passage 108. Passage 108, preferably, has an entrance taper of approximately 1° to provide a sealed connection therewith, without the need of adhesives or other sealing means. Continued movement of the spout assembly toward the distal end of the nozzle body 24, enables the inner end of the inner ferrule to be telescoped into the bore that defines the fuel passage 32 of the adapter 86. This bore is counterbored to receive the hub 72 of the inner ferrule, with both the hub and its reduced diameter being received with a minimal clearance and the O-ring 110 compressed therebetwcen.

Continued inward movement of the spout assembly causes the spout tube 34 to be inserted into the inner diameter of the outer tubular portion 94, of the adapter 86, compressing, the O-ring 112 therebetween. Inward movement of the spout assembly is limited by engagement of the locator ring 54 with the end of the outer tubular portion 94 of the adapter 86. It will be noted that the end of the outer tubular portion 94 is slotted and the locator ring comprises lugs 114 that are received in these slots and bottom thereagainst to longitudinally position the spout assembly. It is to be noted that the adapter 86 is longitudinally positioned relative to the nozzle body 24 by engagement of the flange on the inner end of the inner tubular portion 93, with the counterbore in which it is received. The lugs 114 are received in slots 115 formed in the distal end of the adapter 86 (seen only in FIG. 6) to lock the spout assembly in an angular sense with respect to the adapter 86. The adapter is, in turn, locked in an angular sense, with respect to the nozzle body 24, by a screw 116 that extends through the nozzle body 24 and is threaded into the vane 96 opposite the vent passage 108.

The final step, in mounting the spout assembly on the nozzle body, is to telescope a spout nut 118 over the distal end of the spout tube 34 and then thread it into an enlarged, distal portion of the nozzle body bore that receives the sealing flange of the outer tube portion 96 of the adapter. The spout nut 118 is provided with a central bore 120 that provides a relatively small clearance with the outer diameter of the spout tube 34 and a counterbore that provides a close clearance with the locator ring 54. The counterbore 122 also forms a shoulder that engages the full annulus of the locator ring 54 to lock the spout assembly against the adapter 86 and thus prevent the spout assembly from being pulled from the nozzle body.

The described construction uniquely minimizes flow losses at the connection of the three fluid passages (fuel, vapor and venting air) in the spout to the corresponding passages in the adapter. Further, in so connecting such passages, a compact space envelope is maintained, all to the end of providing a nozzle that can be used by a service station customer with the same convenience as found in a conventional nozzle that does not have a vapor recovery capability.

The features providing such advantages include the inner ferrule 70 and the enlarged inner end portion of the outer tube 34. The enlarged outer tube portion enables the seal between the tube 34 and the adapter to be obtained through the use of an O-ring that is effective on cylindrical surfaces thereof. This is a highly effective means of attaining a seal, and is preferred to seals in which the O-ring is compressed between two clamping surfaces and can be extruded so that its sealing effectiveness is lost. To digress briefly, there is a further O-ring 123 effective between the spout nut 120 and the outer spout tube 34. The counterbore for this seal can also be dimensioned so that the O-ring 123 does not extrude and lose its effectiveness, when the spout nut is fully torqued.

The enlarged inner end of the tube 34 also enables the flow areas for fuel and vapor to be sized that any flow losses are minimized, while a compact space envelope is maintained. Thus, the flow area of the fuel, is essentially the same throughout the length of the spout. The annular flow area for the vapor return passage is also essentially the same throughout length of the spout and particularly at its juncture with the adapter 86. Thus, even though the inner diameter of the generally annular flow path is increased, there is a corresponding increase in the outer diameter of the flow path, due to the enlarged diameter of the inner end portion of the outer tube 34. This increase in diameter is sufficient to provide, at a minimum, approximately the same vapor flow area as in the distal portions of the spout, notwithstanding the presence of the ferrule hub 72 and vanes 78, 84.

In completing the description of the spout assembly 22, its failure mode will be detailed. When fuel is being dispensed from the nozzle 20, the spout is inserted into the fill pipe of a vehicle fuel tank. It will be noted that a wire 119 is coiled about the outer spout tube 34. Such a coiled wire, also referenced as a spring, is conventionally provided to assist in maintaining the nozzle spout in its inserted position in the fill pipe (illustrated in FIG. 19). The present spout construction permits this convenience feature to be provided, without any additional expense insofar as providing the other advantages of the invention.

From time to time, a motorist is forgetful and drives away with the nozzle spout still inserted into the inlet pipe of his vehicle's fuel tank. The groove 62, in the aluminum outer spout tube 34 provides a predetermined failure mode that minimizes the extent of damage that will be incurred when a driveaway occurs. The provision of such a fracture groove is a known expedient in non-vapor recovery nozzles. Aluminum tube spouts and fracture grooves therefor have been developed to a highly reliable state. One feature of the present invention is that this proven technology is incorporated in a spout that provides a vapor return passage. Thus loading which will cause the spout tube 34 is reliably set at less than the force, or loading, required to rupture the hose, or topple the dispenser to which the hose is attached. Rupturing of the hose or toppling of the dispenser would result in damage to more expensive components, and, further, would involve the additional hazard of an uncontrolled discharge of fuel.

It is to be further appreciated that, once the outer spout tube 34 fractures at the groove 62, it can readily release from the inner tube 36. This is to note that, preferably, there is no bonded connection between the outer ferrule 50 and the inner spout tube 36. Thus there is no need to rupture the tube 36, and introduce the possibility that the force required to rupture that tube would be sufficient to rupture the coaxial hose or topple the dispenser, or otherwise impede separation of the outer spout tube from the nozzle.

FIGS. 15–17 illustrate a spout assembly 22' that is also shown in the above-referenced parent application, Ser. No. 986,521. The spout assembly 22' is, likewise, adapted to be mounted on a nozzle body (not shown) to provide a fuel dispensing nozzle having a vapor recovery capability. The spout assembly 22' comprises an outer tube 34' and an inner tube 36'. The inner tube 36' defines the spout portion of a fuel passage 32' and combines with the outer tube 34' to define an annular, vapor return passage 40'. Holes 38', in the tube 34', adjacent its distal end, provide an entrance to the vapor return passage 40'.

The distal ends of the tubes 34' and 36' are joined by a ferrule 50'. A vent tube 52' is mounted in a slot in the ferrule 50' and is in communication with a vent opening 66' in the outer tube 34'. The vent tube 52' extends from a six o'clock position at the distal end of the nozzle to a three o'clock position at the inner end of the spout 22', as viewed in FIG. 17. As will be evident from the foregoing, the distal end portion of the spout assembly 22' is configured in substantially the same fashion as the distal end portion of the spout assembly 22, first described. The inner end portion of the spout assembly 22' is configured in a different fashion. The differences in the inner end portion of the spout assembly 22' are designed to enable the spout assembly 22' to be mounted in a nozzle body and adapter design that differs from the nozzle body and adapter on which the present spout assembly (22) is mounted. The configuration of the inner end portion of the spout assembly 22' has no relation to the present invention. It is sufficient to appreciate that the spout assembly 22, when joined to the nozzle body described in said parent application, is provided with appropriate connections with vapor return passages and fuel passages in the nozzle body. The vent tube 52' is likewise connected to a venturi automatic shut-off mechanism.

The spout assembly 22' may also be advantageously formed employing synthetic resin components, commonly referenced as plastics. FIG. 18 illustrates the distal end portion of a spout construction 22", employing "plastic" components. These components are identified by like reference characters, which have a "double prime" designation. The outer tube 34" may be of a "structural" type resin. There are many "structural" type resins that could be employed for such purpose, delrin being an example. The ferrule 50", inner tube 36" and vent tube 52" may also be formed of "structural" resins. In general, "structural" resins have a relatively low resilience, that is, they take a permanent set, after they have been strained to a relatively limited extent. Because of the widely varying temperatures to which fuel nozzles are subject, and the resultant thermal expansion and contraction, there is a tendency for the effectiveness of interference fits to be lost over a period of time. Thus, when employing "structural" resins, it is preferred to employ an independent bonding mechanism, such as a glue, solvent or thermal fusion, to hold the spout components in assembled relation.

The inner tube 36" could also, and preferably is formed of a flexible type resin, or rubber, which is essentially rigid when subject to axial compression despite being laterally flexible, i.e., bendable. By so doing, fabrication and assembly of the spout may be simplified. This is to say that the outer tube 34" could be molded, of a "structural" resin in the final, curved configuration illustrated in FIG. 15. Then, with the inner tube 36" formed of a flexible material and attached to a ferrule 50", which may also be formed of a synthetic resin, the inner tube can be inserted into the curved outer tube and then bonded, by adhesive or the like, to complete the spout subassembly. The inner tube 36" is adapted to be sealingly telescoped into sealing relation with the fuel passage of an adapter, taking note that the inner tube 36, of the first embodiment, is likewise telescoped into sealed relation with the fuel passage of adapter 86.

In the first embodiment, there is an inner ferrule interposed between the inner tube 34 and the adapter 86. In said parent application the adapter fuel passage is adapted to directly receive the inner end of the inner spout hose. The point being made is that, in both cases, where flexible synthetic resins are employed, as nylon 66, the inner tube has sufficient axial strength to resist the forces associated with the telescoping action by which a sealed connection is made as the inner tube is telescoped into connected relation.

The vent tube 52" may also be formed of a flexible, axially rigid resin. The same properties which facilitate connection of the flexible, axially rigid inner tube 36", to the nozzle portion of the fuel passage 32" also facilitate connection of the flexible, axially rigid vent tube 52" to an adapter, in a fashion equivalent to that described in connection with the first embodiment. Where synthetic resins are used for the tubes 34" or 36" it is preferred that the resin be electrically conductive. Electrically conductive resins, suitable for the present purposes are well known and commercially available.

The use of resinous materials can also enable elimination of the ferrule 50" as a separate element, as is illustrated in FIG. 18. This is to say that the reenforcement function provided by the ferrule 50" can be economically attained by forming the ferrule as an integral part of the outer tube 34" or as an integral part of the inner tube 36". The ferrule 50" is not a separate element, but, instead is integrally molded with the inner tube 36".

Figure 20:
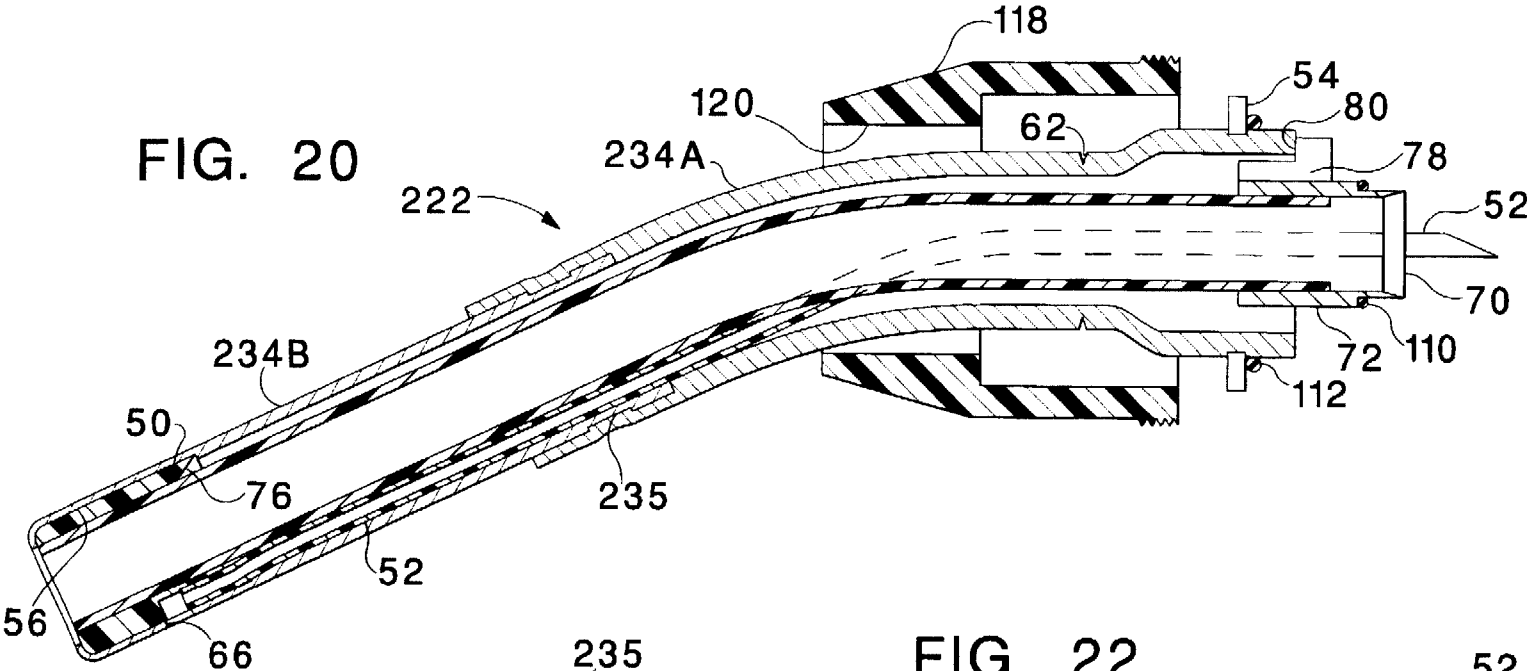
FIG. 20 is an elevation, in longitudinal section and on an enlarged scale, similar to FIG. 2, of the alternate spout construction subassembly.
Figure 22:
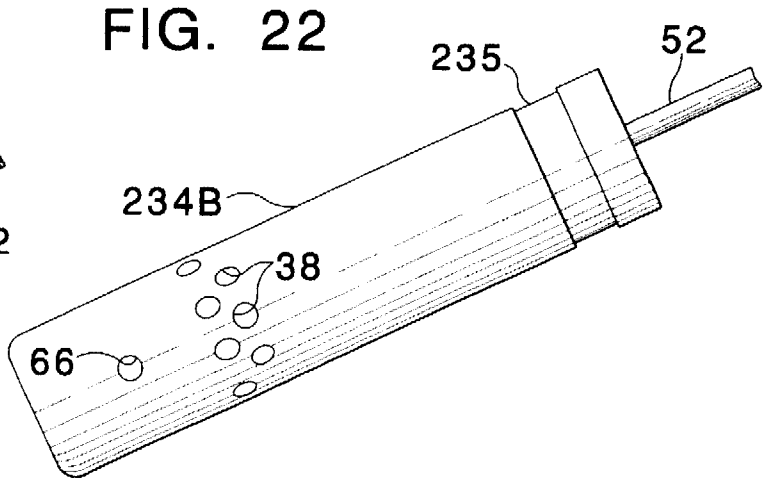
FIG. 22 is a bottom view of the subassembly seen in FIG. 21.
Figure 21:
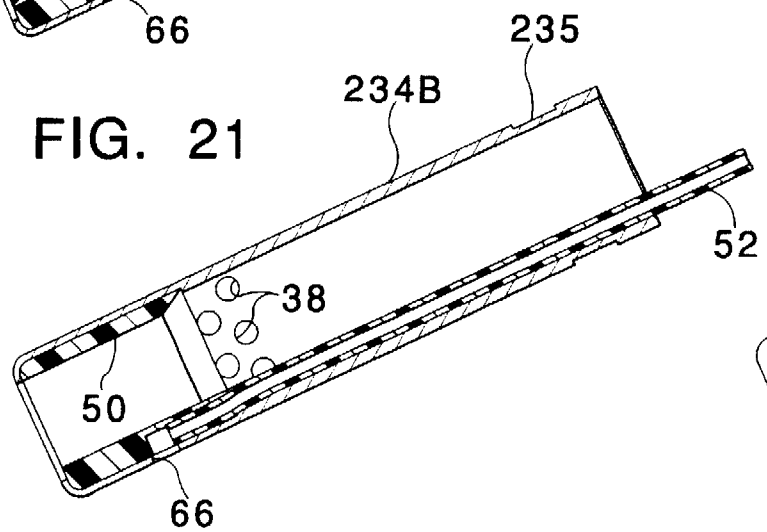
FIG. 21 is an elevation, in longitudinal section, separately illustrating a subassembly seen in FIG. 20.
Figure 23:
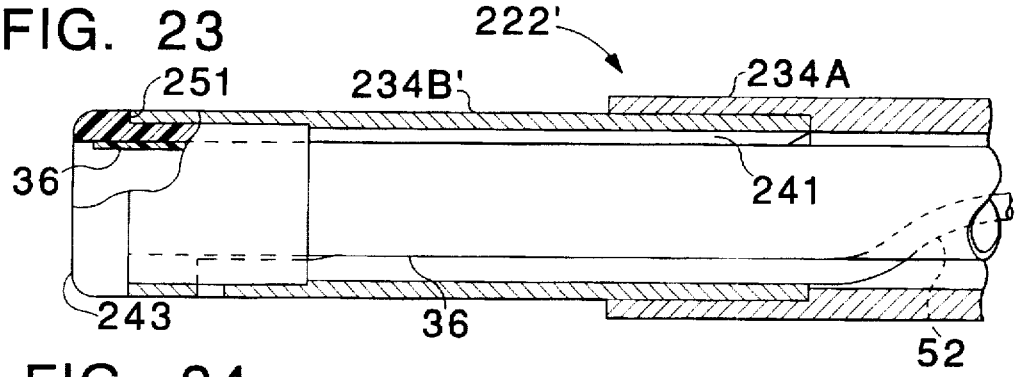
FIG. 23 is a side elevation, in partial longitudinal section, of an alternate construction for the subassembly illustrated in FIGS. 20–22.
Figure 24:
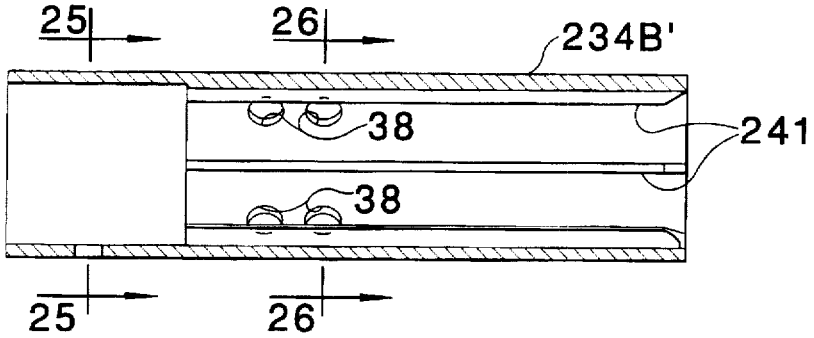
FIG. 24 is a longitudinal section of a component of the alternate subassembly seen in FIG. 23.
Figure 25:
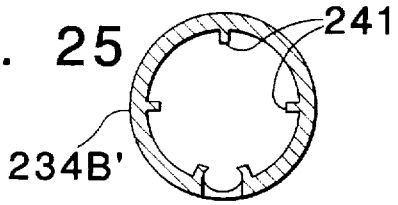
FIG. 25 is a section taken on line 25—25 in FIG. 24.
Figure 26:
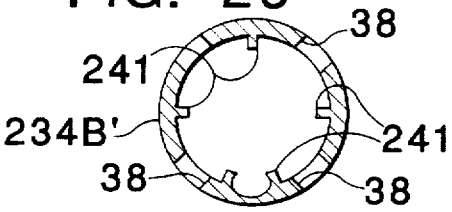
FIG. 26 is a section taken on line 26—26 in FIG. 24.

Reference is next made to FIGS. 20–22 for a description of an alternate spout construction that is generally identified by reference character 222. The primary advantage of this embodiment of the invention is in providing greater strength for the distal end portion of the outer spout tube. As discussed above, the conflicting constraints of a maximum diameter that is insertable through a no lead restricter plate, and the need for maximized flow areas for fluid and vapor flows, lead to a minimization of the wall thickness of the outer spout tube. The distal end portion of the outer spout tube thus becomes vulnerable to damage in the normal wear and tear in usage of the nozzle.

This vulnerability is overcome in spout assembly 222 by forming the outer spout tube as an inner portion 234A and an outer portion 234B. The inner spout portion 234A is preferably formed of aluminum in the same fashion described above and differs from the outer spout tube 34 primarily in that it has a shorter, distal end portion. The advantages described with respect to the inner end portion of the spout tube 34, e.g., enlarging of the inner end and mounting of a locator ring 54 remain the same.

The outer end portion 234B of the spout tube is formed of stainless steel, which provides a much greater strength for this portion of the spout tube, with the same or even a reduced wall thickness. The stainless steel tube is simply telescoped into the distal end of the aluminum, inner tube 234A and then secured in place. Preferable, the distal end portion of the aluminum spout tube 234A is counterbored to provided an accurate fit between and axial positioning of the stainless steel tube relative thereto. The tube portion 234 is then secured in place. An effective way of securing the tube 234B is to form a groove 235 circumferentially on its inner end portion. Then after it has been telescoped into the outer tube 234A, a rolling operation is performed to swage the outer tube metal into the groove 235.

The outer tube portion 234B, at its distal end may be provided with the same ferrule 50, as was employed with the spout 34, previously described. The distal end of the tube 234B is then rolled to lock the ferrule in place. The ferrule 50 makes provision for mounting a vent tube 52 in the same fashion, as before, for communication with a vent opening 66 in the tube 234B. The tube 234B is also provided, as before, with entrance holes 38 to the vapor return passage 40.

The ferrule 50 and vent tube 52 are indicated, in FIGS. 21, 22, as being mounted, on the outer tube 234B to form a subassembly, which is then mounted on the inner tube portion 234A. However, it would also be possible to first mount the tube portion 234B on the tube portion 234A, and then to mount the ferrule 50 and vent tube 53.

FIGS. 23–26 illustrate an alternate approach to strengthen the outer end portion of the outer spout tube. This spout construction, identified by referenced character 222', may be the same as the spout construction 222, just described except for the outer end tube portion 234B. The tube portion 234B' is preferably formed from an extruded aluminum tube, which has longitudinal strengthening ribs 241. The ribs 241 permit the economical use of extruded aluminum tubing, with a minimum of machining, to form the tube portion 234B'.

The extrusion, after being cut to the proper length, is simply counter bored (to remove the ribs) to form a seat for a modified ferrule 250. The ferrule is preferable formed of a structural resinous material, such as nylon, and is simply telescoped into assembled relation with the outer tube portion 234B', abutting against a shoulder 251, so that the outer tube portion is formed by the resinous plastic ferrule 243. The ferrule 243 can be held in assembled relation by appropriate solvent or adhesive means.

While illustrated in connection with the compositely formed outer tube 234', it is to be understood that the resinous ferrule 243 could also be employed, with advantage, in joining an inner tube (36) to an integral outer tube (34) construction as was described in connection with the first embodiment of FIGS. 1–7.

The compositely formed outer spout tubes 234A/234B or 234A/234B' can be assembled with an inner tube assembly 48 as previously described. In this connection it is to be noted that the inner ends of the ribs 241 are beveled at 245 to facilitate entrance of the distal end of the inner tube 38 during assembly.

With respect to the outer tube 234B' it is to be noted that the lower two ribs 241 are closely spaced and adapted to receive the vent tube 52 and facilitate its positioning during assembly.

Figure 27:
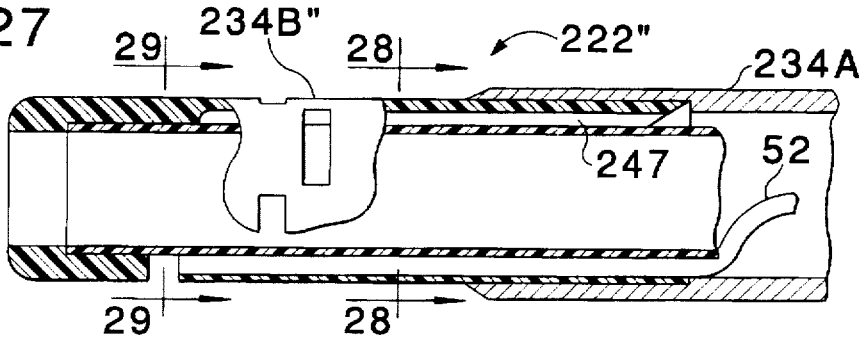
FIG. 27 is a side elevation, in partial longitudinal section, of another alternate construction for the subassembly illustrated in FIGS. 20–22.
Figure 28:
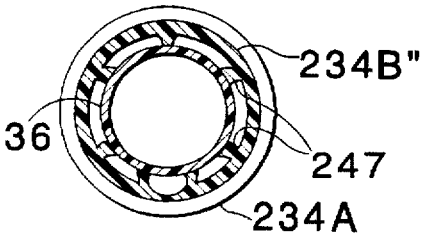
FIG. 28 is a section taken on line 28—28 in FIG. 27.
Figure 29:
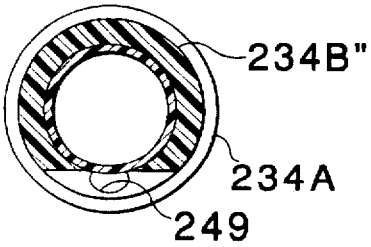
FIG. 29 is a section taken on line 29—29 in FIG. 27.

FIGS. 27–29 illustrate another alternate approach to strengthening the outer end portion of the outer spout tube. This spout construction, identified by reference character 222", may be the same as the spout construction 222, just described except for the outer end tube portion 234B. The tube portion 234B" is preferably formed from by a die cast structural resin, nylon or acetal resins being suitable. The tube portion 234B" has integral longitudinal strengthening ribs 247, which are similar to the ribs 241 in the previous embodiment.

The tube portion 234B" is simply inserted in the bore in the distal end of the aluminum tube portion 234A and then may be secured, as by bonding with a suitable adhesive. In this embodiment, the use of a ferrule is eliminated. Thus after the tube portion 234B" is secured in place, the inner tube assembly 48 may be assembled with the modified outer tube assemble to dispose the inner tube 36 in its illustrated position. In this case, it may be appropriate to seal the inner tube 36 with respect to the bore in the tube portion 234B" that receives it. A suitable adhesive or solvent could provide the sealing function.

Vapor return entrance openings 38 permit flow of vapor to the portion of the vapor return passage that is defined by the tube portion 234B" and the inner tube 36. Return vapor then flows between the ribs 247 to the annular passage defined by the upper spout tube 234A.

Similar to the previous embodiment, the bottom two ribs 247 define a means for mounting the vent tube 52. The entrance to the vent passage tube is illustrated in FIG. 29 at 249.

It is to be noted that, in the embodiments employing a compositely formed outer tube 234, the outer portion 234B, 234B' and 234B", are preferably straight lengths of tubing like elements. The curvature that is provided to angle the distal end of the spout is all provided in the inner spout portion 234A.

Other variations and deviations from the specific embodiment first described, will occur to those skilled in the art, within the spirit and scope of the invention, as set forth in the following claims.

Having thus described the invention, what is claimed as novel and desired to be secured by Letters Patent of the United States is:

1. A fuel nozzle, comprising:

a nozzle body having a fuel passage and a vapor passage;

a spout connected to said nozzle body and having a distal end for dispensing fuel and a proximal end for engaging said nozzle body, said spout having a bend therein between said proximal end of said spout and said distal end of said spout, said spout comprising an outer tube and a laterally flexible inner tube disposed substantially within said outer tube, said outer tube and said inner tube forming an annulus therebetween and said inner and outer tubes having proximal and distal ends; and said inner tube communicating with said fuel passage for receiving fuel therefrom and discharging the fuel at said distal end of said spout, said annulus communicating with said vapor passage for directing vapors from said distal end of said spout through said spout and said nozzle body.

2. A fuel nozzle as in claim 1, wherein said inner tube is formed from a synthetic resin.

3. A fuel nozzle as in claim 1, further comprising a first ferrule engaging said proximal end of said inner tube for positioning said inner tube relative to said outer tube.

4. A fuel nozzle as in claim 3, wherein said first ferrule further comprises a central hub engaging said inner tube and a plurality of outwardly projecting vanes engaging the inner diametrical surface of said outer tube to position said inner tube relative to said outer tube.

5. A fuel nozzle as in claim 1, further comprising:

a locator ring having a plurality of inwardly projecting first lugs engaging said outer tube and a plurality of outwardly extending second lugs for positioning said spout with respect to said nozzle body.

6. The fuel nozzle of claim 1, wherein said distal end of said outer tube comprises a counterbore, and wherein said nozzle further comprises a second ferrule engaging said counterbore and said inner tube engaging said second ferrule.

7. A fuel nozzle as in claim 6, wherein said inner tube is upwardly offset relative to the outer diameter of said second ferrule.

8. A fuel nozzle as in claim 1, wherein the vapor flow area of said annulus is substantially constant between said proximal end of said spout and said distal end of said spout.

9. A fuel nozzle as in claim 1, further comprising a vent tube extending from an opening in said outer tube adjacent said distal end of said spout to a venturi vent passage in said nozzle body, said vent tube being formed of a synthetic resin and being relatively flexible in a lateral direction.

10. The fuel nozzle of claim 1, wherein said outer tube has a wall thickness of approximately 0.05 inches adjacent its distal end and a wall thickness of approximately 0.125 inches along substantially the balance of its length, and the inner tube has a wall thickness of approximately 0.02 inches.

11. A fuel nozzle as in claim 1, further comprising an adapter disposed at least partially in said nozzle body and having an inner tubular portion defining a central fuel flow passage which is in fluid communication with said fuel passage of said nozzle body and an outer tubular portion sealingly engaging said outer tube, said inner tubular portion being sealingly engaged with said inner tube.

12. The fuel nozzle of claim 1, wherein said distal end of said outer tube has a bending strength greater than that of said proximal end of said outer tube.

13. The fuel nozzle of claim 1, wherein said proximal end of said outer tube comprises a first material and said distal end of said outer tube comprises a second material.

14. The fuel nozzle of claim 13, wherein said first material comprises aluminum and said second material comprises stainless steel.

15. The fuel nozzle of claim 13, wherein said first material comprises aluminum and said second material comprises an aluminum extrusion having one or more longitudinal, inwardly projecting ribs.

16. The fuel nozzle of claim 15, wherein each of said ribs has an inner surface which lies on a circular outline approximating the outside diameter of said inner tube.

17. The fuel nozzle of claim 13, wherein said first material comprises aluminum and said second material comprises a structural synthetic resin.

18. A fuel nozzle, comprising:

a nozzle body having a fuel passage and a vapor passage;

a spout connected to said nozzle body having a distal end for dispensing fuel and a proximal end engaging said nozzle body, said spout having a bend therein between said proximal end of said spout and said distal end of said spout, said spout comprising an outer tube and an inner tube disposed substantially within said outer tube, said outer tube and said inner tube forming an annulus therebetween, said inner and outer tubes having proximal and distal ends;

said inner tube communicating with said fuel passage and adapted to receive fuel therefrom and to discharge the fuel adjacent said distal end of said spout, said annulus communicating with said vapor passage for directing vapors from adjacent said distal end of said spout through said spout and to said nozzle body; and a positioning element disposed adjacent said proximal end of said spout, said positioning element fixedly engaging said proximal end of said inner tube and positioning said proximal end of said inner tube with respect to said outer tube, said positioning element limiting movement of said inner tube toward said distal end of said spout.

19. A fuel nozzle as in claim 18, wherein said inner tube is laterally flexible with respect to said outer tube.

20. A fuel nozzle as in claim 18, wherein said inner tube is formed from a synthetic resin.

21. The fuel nozzle of claim 18, wherein said positioning element comprises a ferrule attached to said inner tube.

22. The fuel nozzle of claim 21, wherein said ferrule further comprises one or more outwardly extending vanes.

23. The fuel nozzle of claim 22, wherein said vanes engage said outer tube to prevent said movement of said inner tube toward said distal end of said spout.

24. A fuel nozzle as in claim 5, comprising a spout nut engaging said nozzle body and engaging said second lugs to mount said spout on said nozzle body.

25. The fuel nozzle of claim 18, wherein the inner diametrical surface of said proximal end of said outer tube is enlarged relative to the inner diametrical surface of said distal end of said outer tube.

26. A fuel nozzle as in claim 18, further comprising a locator ring having a plurality of inwardly projecting first lugs engaging said outer tube and a plurality of outwardly extending second lugs for positioning said spout with respect to said nozzle body.

27. A fuel nozzle as in claim 26, further comprising a spout nut engaging said nozzle body and engaging said second lugs to mount said spout on said nozzle body.

28. The fuel nozzle of claim 27, wherein said outer tube further comprises a fracture groove disposed between said locator ring and said distal end of said spout, whereby a first portion of said outer tube comprising said distal end of said spout axially separates from said spout when said groove fractures in the event of a vehicle being driven away with the spout inserted in its fill pipe and whereby a second portion of said spout comprising said proximal end of said spout remains connected to said nozzle body by said spout nut during the drive away event.

29. A spout for use with a dispensing nozzle having a nozzle body with a fuel passage and a vapor passage, said spout comprising:

a distal end for dispensing fuel and a proximal end for engaging the nozzle body, said distal end of said spout being angled downwardly from said proximal end of said spout;

an outer tube and a laterally flexible inner tube disposed substantially within said outer tube, said outer tube and said inner tube forming an annulus therebetween and having proximal and distal ends substantially corresponding to said proximal and distal ends of said spout; and said inner tube communicating with the fuel passage for receiving fuel therefrom and discharging the fuel at said distal end of said spout, said annulus communicating with said vapor passage for directing vapors from said distal end of said spout through said spout to the nozzle body.

30. A spout as in claim 29, wherein said inner tube is formed from a synthetic resin.

31. A spout as in claim 30, wherein said first ferrule further comprises a central hub engaging said inner tube and a plurality of outwardly projecting vanes engaging the inner diametrical surface of said outer tube to position said inner tube relative to said outer tube.

32. A spout as in claim 29, further comprising a locator ring having a plurality of inwardly projecting first lugs engaging said outer tube and a plurality of outwardly extending second lugs for positioning the spout with respect to the nozzle body.

33. A spout as in claim 29, further comprising a first ferrule engaging said proximal end of said inner tube for positioning said inner tube relative to said outer tube.

34. The fuel nozzle of claim 18, wherein said positioning element positions said inner tube substantially centrally within said proximal end of said outer tube.

* * * * *

UNITED STATES PATENT AND TRADEMARK OFFICE

CERTIFICATE OF CORRECTION

PATENT NO. : 5,765,609
DATED : Jun. 16, 1998
INVENTOR(S) : Dalhart et al.

It is certified that error appears in the above-identified patent and that said Letters Patent is hereby corrected as shown below:

Column 1, line 8, please delete "letter" and insert therefor --latter--.
Column 1, line 58, please delete "thec" and insert therefor --the--.

IN THE CLAIMS

Please add the following claim:

--35. The fuel nozzle of claim 6, wherein said second ferrule projects beyond said distal end of said outer tube--.

Signed and Sealed this
Fifth Day of January, 1999

*Attest:*

*Attesting Officer*

*Acting Commissioner of Patents and Trademarks*